United States Patent [19]

Hashimoto

[11] Patent Number: 4,698,970

[45] Date of Patent: Oct. 13, 1987

[54] STIRLING CYCLE TYPE ENGINE

[75] Inventor: Kenji Hashimoto, Isesaki, Japan

[73] Assignee: Sanden Corporation, Gunma, Japan

[21] Appl. No.: 855,711

[22] Filed: Apr. 25, 1986

[30] Foreign Application Priority Data

| | | | |
|---|---|---|---|
| Apr. 25, 1985 | [JP] | Japan | 60-89472 |
| Apr. 25, 1985 | [JP] | Japan | 60-89473 |
| Apr. 25, 1985 | [JP] | Japan | 60-89474 |
| Apr. 25, 1985 | [JP] | Japan | 60-89475 |
| Apr. 25, 1985 | [JP] | Japan | 60-89479 |
| Apr. 25, 1985 | [JP] | Japan | 60-89480 |
| Apr. 25, 1985 | [JP] | Japan | 60-89481 |
| Apr. 26, 1985 | [JP] | Japan | 60-88949 |

[51] Int. Cl.[4] ..... F02G 1/04

[52] U.S. Cl. ..... 60/525

[58] Field of Search ..... 60/525

[56] References Cited

U.S. PATENT DOCUMENTS

| | | | |
|---|---|---|---|
| 2,817,950 | 12/1957 | Van Weenen et al. | 60/525 |
| 3,478,511 | 11/1969 | Schwemin | 60/525 |

*Primary Examiner*—Allen M. Ostrager

*Attorney, Agent, or Firm*—Banner, Birch, McKie & Beckett

[57] ABSTRACT

A Stirling cycle type engine having five cylinders annularly and equiangularly arranged is disclosed. The expansion chamber of one cylinder is connected to the compression chamber of an adjacent cylinder through a cooler device, a regenerator, and a heater device. The cooler device, regenerator, and heater device are serially stacked and are contained within a cylindrical element. The five cylinders and five cylindrical elements which function as heat exchanging means are supported by a frame having a plurality of plate elements. Each heater device is placed on one of the plate elements adjacent the expansion chamber of one of the cylinders.

13 Claims, 15 Drawing Figures

32
22
223
222
221
27
A
B
21
24

STIRLING CYCLE TYPE ENGINE

TECHNICAL FIELD

The present invention relates to a stirling cycle type engine. More particularly, the present invention relates to an improved arrangement of cylinders and heat exchanging portions of a Stirling cycle type engine.

BACKGROUND OF THE INVENTION

Stirling cycle type engines are well known in the prior art. A Stirling cycle type engine operates on a regenerative thermodynamic cycle with cyclic compression and expansion of the working fluid at different temperature levels. The fluid flow is controlled by volume changes which create a net conversion of heat to work or vice versa. In a typical Stirling cycle type engine operating as a prime mover, heat is supplied to the working fluid at some high temperature when the fluid is in a hot chamber. Part of the heat is converted to work when, due to the absorbed heat, the working fluid expands and pushes on a piston, which is coupled to a crank shaft that imparts rotary motion. The working fluid is then displaced by a displacer through the hot chamber, through a regenerator where most of the heat is drawn off, and into a cold chamber, which is at some lower temperature. The piston then compresses the working fluid at the lower temperature. Next, the displacer pushes the working fluid through the cold chamber, through the regenerator, and into the hot chamber. As it passes through the regenerator the working fluid reabsorbs some of the heat previously deposited there. In the hot chamber the working fluid again absorbs heat and the cycle of operation repeats itself.

FIG. 1 is a schematic view of a prior art embodiment of a Stirling cycle type engine. This engine has four cylinders 1 which are annularly and equiangularly arranged, each having a displacer-piston 2 reciprocatingly disposed within it. Displacer-piston 2 divides the interior of cylinder 1 into two chambers: a hot or expansion chamber, and a cold or compression chamber. The hot chamber of one cylinder 1 and the cold chamber of an adjacent cylinder 1 are connected to each other through heater 3, regenerator 4 and cooler 5 which are serially connected. Each displacer-piston 2 is connected to incline plate 6 through connecting rod 7. This converts the reciprocating motion of the displacer-piston to rotating motion of output shaft 8.

In these Stirling cycle type engines four cylinders 1 are annularly and equiangularly arranged. This creates a large torque on output shaft 8 and hinders the smooth rotation of the shaft. Also, volumeric output of the engine is low. Thus, the Stirling cycle type engine of this type does not operate at high rotation speeds or high efficiency. Furthermore, the fastening structures for the heater and the cooler are very complicated. Also, the heat from the external heating source may be transferred to the cold chamber, causing heat conduction loss.

SUMMARY OF THE INVENTION

It is a primary object of this invention to provide an improved Stirling cycle type engine which is compact in structure and achieves high rotation speeds and high efficiency.

Another object of this invention is to provide a Stirling cycle type engine which prevents heat transfer from the external heat source of the heater to the cooler or cooling chamber of the cylinder.

Another object of this invention is to provide a Stirling cycle type engine in which the heater portion is easily fastened thereto.

A Stirling cycle type engine in accordance with this invention includes five cylinders, and a displacer-piston slidably fitted within each cylinder which divides the interior space of the cylinder into expansion and compression chambers. The expansion chamber of one cylinder is connected to the compression chamber of an adjacent cylinder through heat exchanging elements. The five cylinders are annularly and equiangularly arranged, as are the five heat exchanging elements. The heat exchanging elements each include a cooler means, a regenerator, and a heater means, serially connected and equidistantly spaced on, and close to, the outside of the cylinders. The cylinders and heat exchanging elements are supported by a supporting frame member which comprises a plurality of plates. The heater means is positioned on one of the plates opposite the expansion chamber of the cylinder. An insulating device is disposed in each space defined by opposing plates.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF PREFERRED EMBODIMENTS

Figure 1:
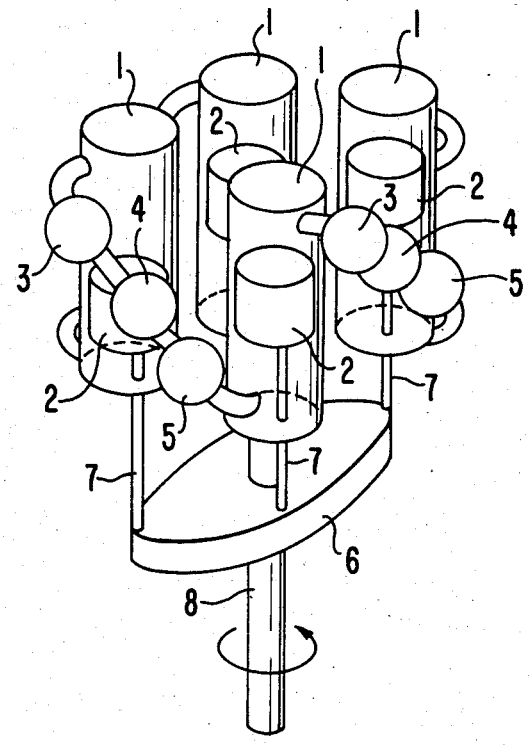
FIG. 1 PRIOR ART
FIG. 1 is a schematic view of a prior Stirling cycle type engine.
Figure 3:
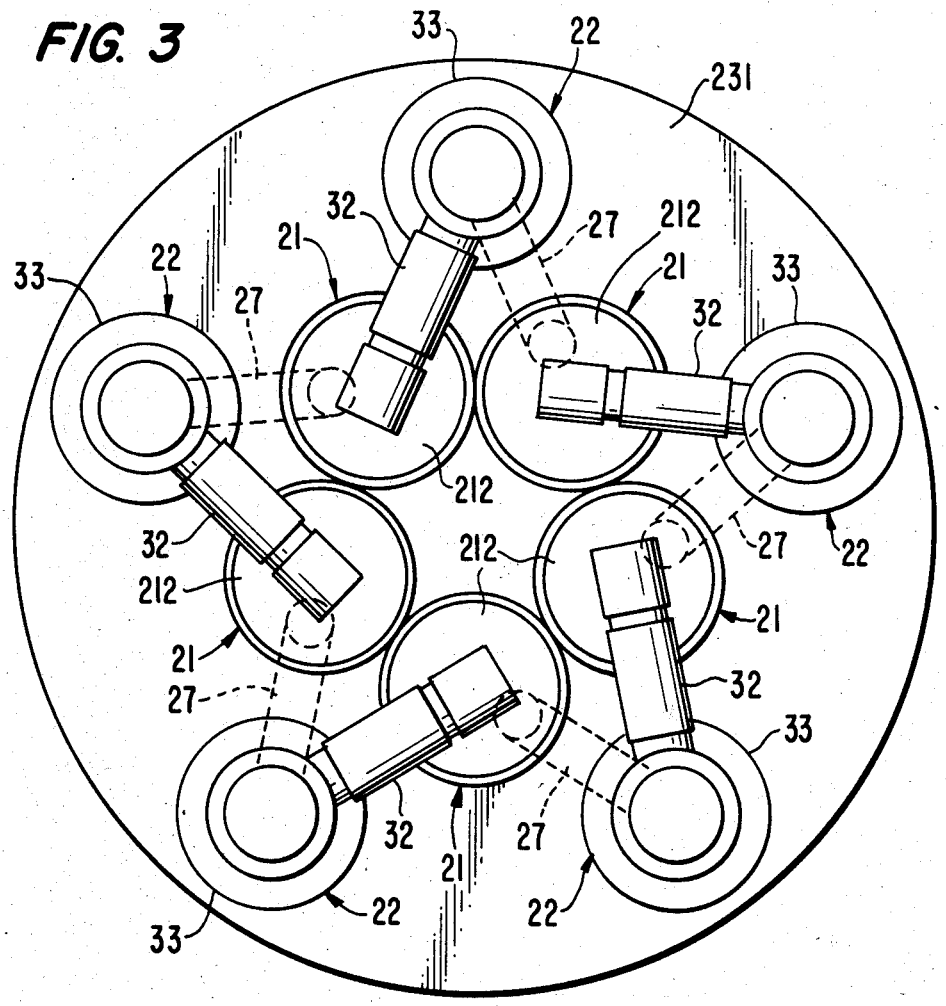
FIG. 3 is a plan view of the Stirling cycle type engine of FIG. 2.
Figure 2:
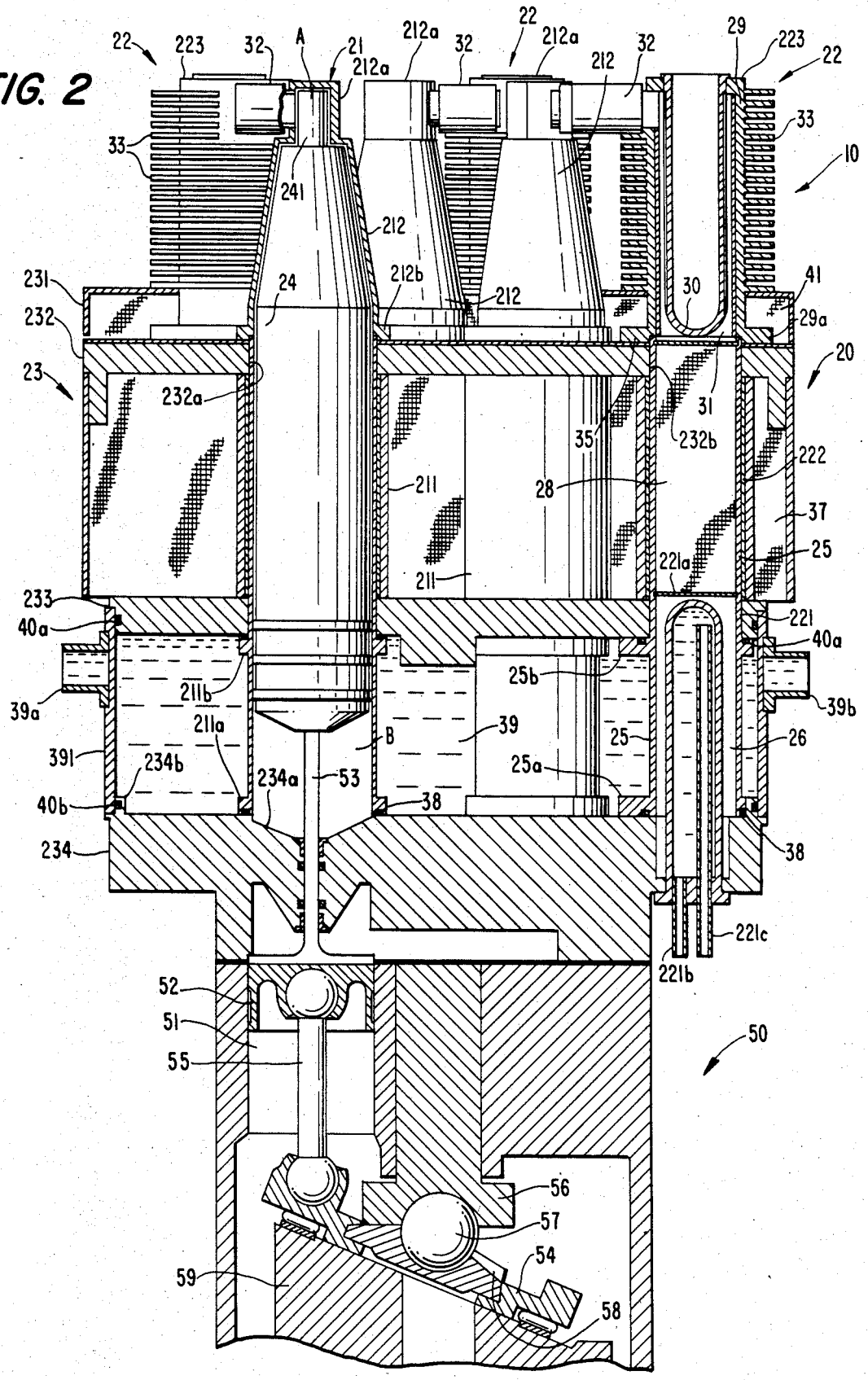
FIG. 2 is a vertical cross-sectional view of a Stirling cycle type engine according to one embodiment of the invention.

Referring first to FIGS. 2 and 3, a Stirling cycle type engine according to one embodiment of this invention is shown. Engine 10 comprises engine body 20 having a plurality of cylinders 21, heat exchanging elements 22, supporting frame member 23 on which cylinders 21 and heat exchanging elements 22 are fastened, and crank portion 50.

In this embodiment, engine 10 has five cylinders 21 which are annularly and equiangularly arranged at 72° increments. Each cylinder 21 comprises cylinder body 211 with upper and lower openings. Cylinder 21 also includes cylinder cup 212 which is disposed on the upper portion of cylinder body 211, closes the upper opening of cylinder body 211, and has cup-shaped projection 212*a* at its top. The lower opening of cylinder body 211 is covered by bottom plate element 234 of supporting frame member 23. Displacer-piston 24 is fitted within cylinder 21 and divides the interior of cylinder 21 into two chambers: expansion chamber A and compression chamber B. Also, displacer-piston 24 has projection 241 at its top portion for slidably fitting in cup-shaped projection 212*a* of cylinder cup 212.

Figure 5:
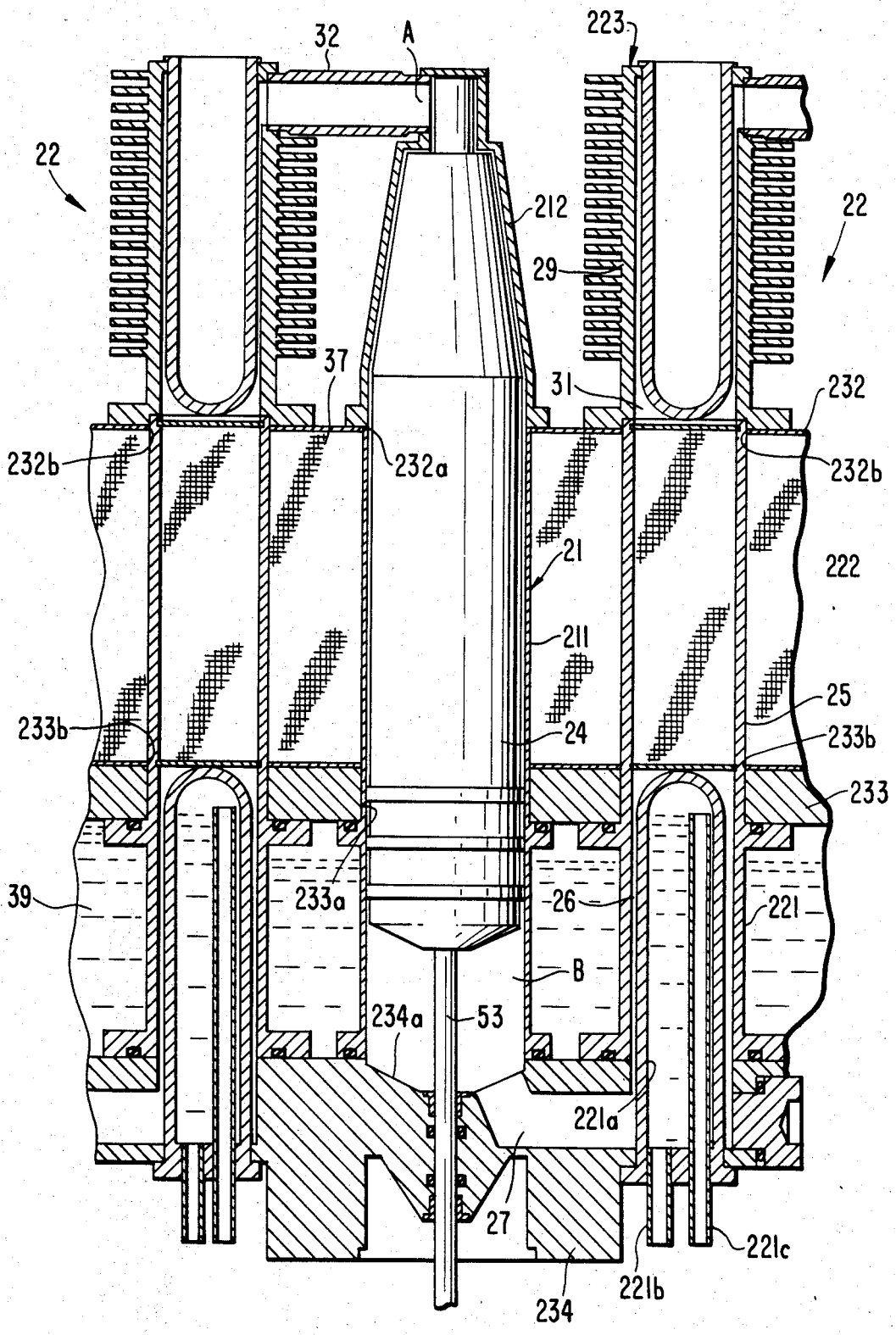
FIG. 5 is an enlarged cross-sectional view of the Stirling cycle type engine of FIG. 2 illustrating the heat exchanging elements.
Figure 6:
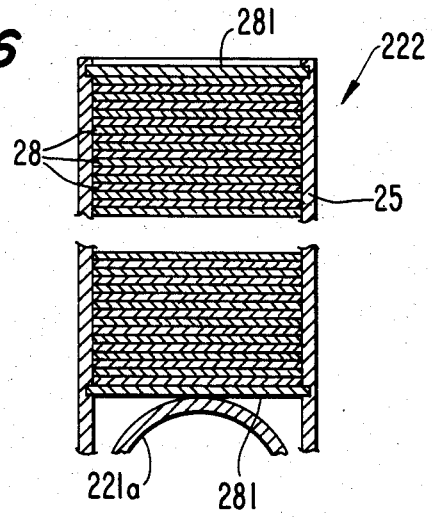
FIG. 6 is a cross-sectional view of a regenerator used in the Stirling cycle type engine of FIG. 2.

Heat exchanging elements 22 are located relatively close to the outside of cylinders 21, and are annularly and equiangularly arranged and placed midway between adjacent cylinders. As best shown in FIG. 5, each heat exchanging element 22 comprises cooler 221, regenerator 222, and heater 223 which are vertically stacked on each other. Annular cylindrical member 25, open at its ends, is disposed around cooler 221 and regenerator 222. Cooler 221 includes cooling liquid container 221*a* and is disposed in cylindrical member 25 with a gap. Cooling liquid supply pipe 221*b* and discharge pipe 221*c* are open to the interior of container 221*a* to circulate the cooling liquid. Water or any other conventional heat exchanging liquid can be used as the cooling liquid. The gap between cylindrical member 25 and container 221*a* functions as cooled fluid passage way 26. Passageway 26 communicates with compression chamber B of cylinder 21 through communicating passageway 27 formed in bottom plate element 234 of supporting frame member 23. A plurality of wire cloths 28 are disposed in the upper portion of cylindrical member 25 around regenerator 222 to prevent heat loss. As shown in FIG. 6, the disc-shaped wire cloths 28 are stacked and held together between supporting wire plates 281 affixed on cylindrical member 25.

Figure 7:
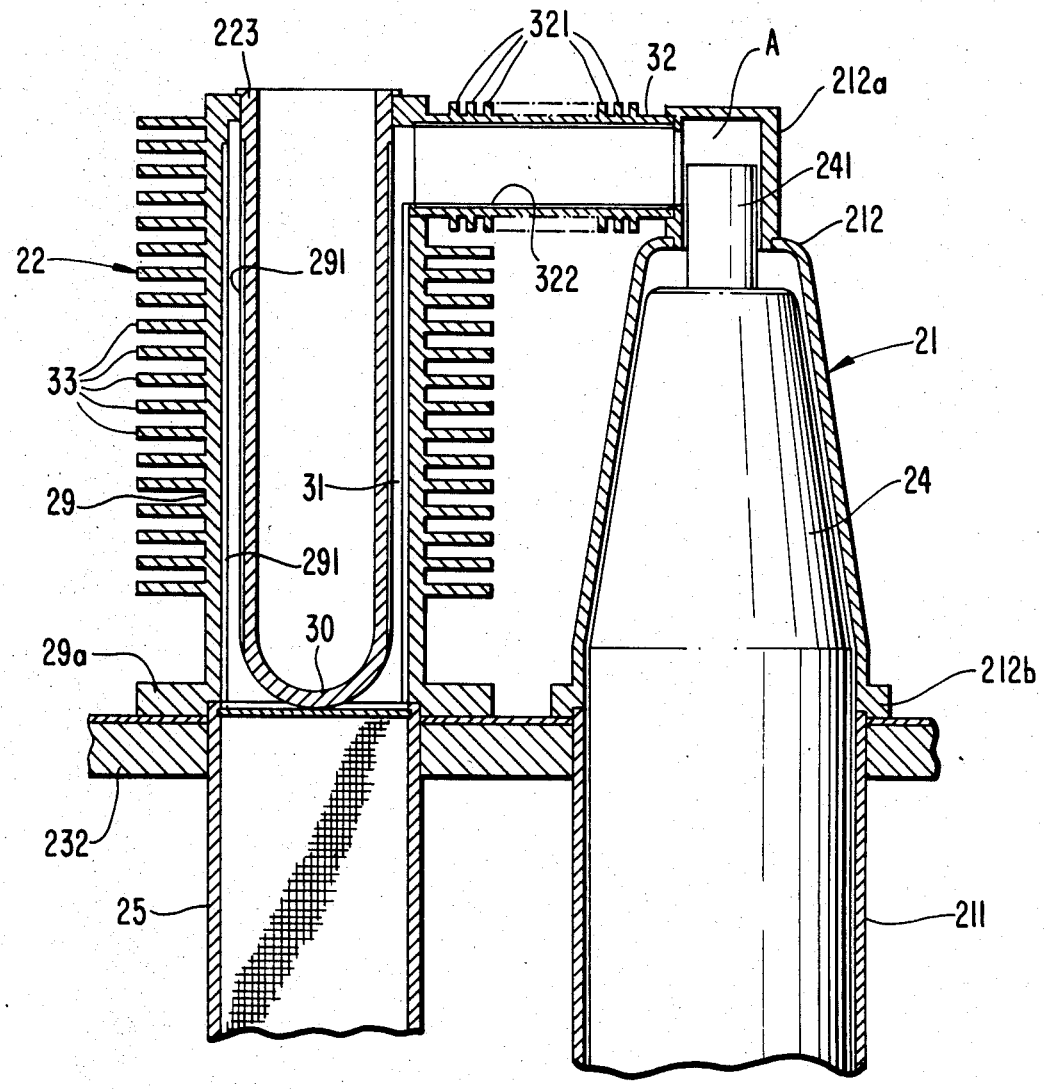
FIG. 7 is an enlarged cross-sectional view of a cylinder and heater of the Stirling cycle type engine of FIG. 2.

Referring to FIG. 7, heater 223 is disposed within a second cylindrical member 29 which resides on top of cylindrical member 25 and is connected to the upper opening of cylindrical member 25. Inner tube 30 having a U-shaped cross-section is disposed within cylindrical member 29 with a gap. The gap defined between the inner surface of cylindrical member 29 and the outer peripheral surface of inner tube 30 functions as heated fluid passageway 31. Passageway 31 communicates with expansion chamber A of cylinder 21 through heated fluid passage pipe 32 which is fixed on cup-shaped projection 212*a* of cylinder cup 212. Thus, the enclosed working fluid is reversably moved to expansion chamber A of one cylinder 21 from compression chamber B of an adjacent cylinder 21 through heat exchanging elements 22. To enlarge the heat exchanging surface of heater 223, a plurality of fins 33 are formed on the outer peripheral surface of cylindrical member 29, and threaded portion 291 is formed on the inner surface of cylindrical member 29 and the outer peripheral surface of inner tube 30. Also, heated fluid passage pipe 32 has a plurality of fins 321 at its outer peripheral surface and threaded portion 322 at its inner surface. Inner tube 30 and pipe 32 may be fastened on cylindrical member 29 and cylinder cup 212 by brazing.

Supporting frame member 23 comprises four plate elements 231, 232, 233 and 234. Upper plate element 231 holds cylindrical member 29 and cylinder cup 212 of cylinder 21. Second plate element 232 secures cylindrical member 29 and cylinder cup 212 through radial flange portions 29*a* and 212*b*. Second plate element 232 has holes 232*a* and 232*b* for holding cylinder 211 and cylindrical member 25, respectively. Insulating member 41, formed of an insulating material, is disposed between upper plate element 231 and second plate element 232.

Figure 8:
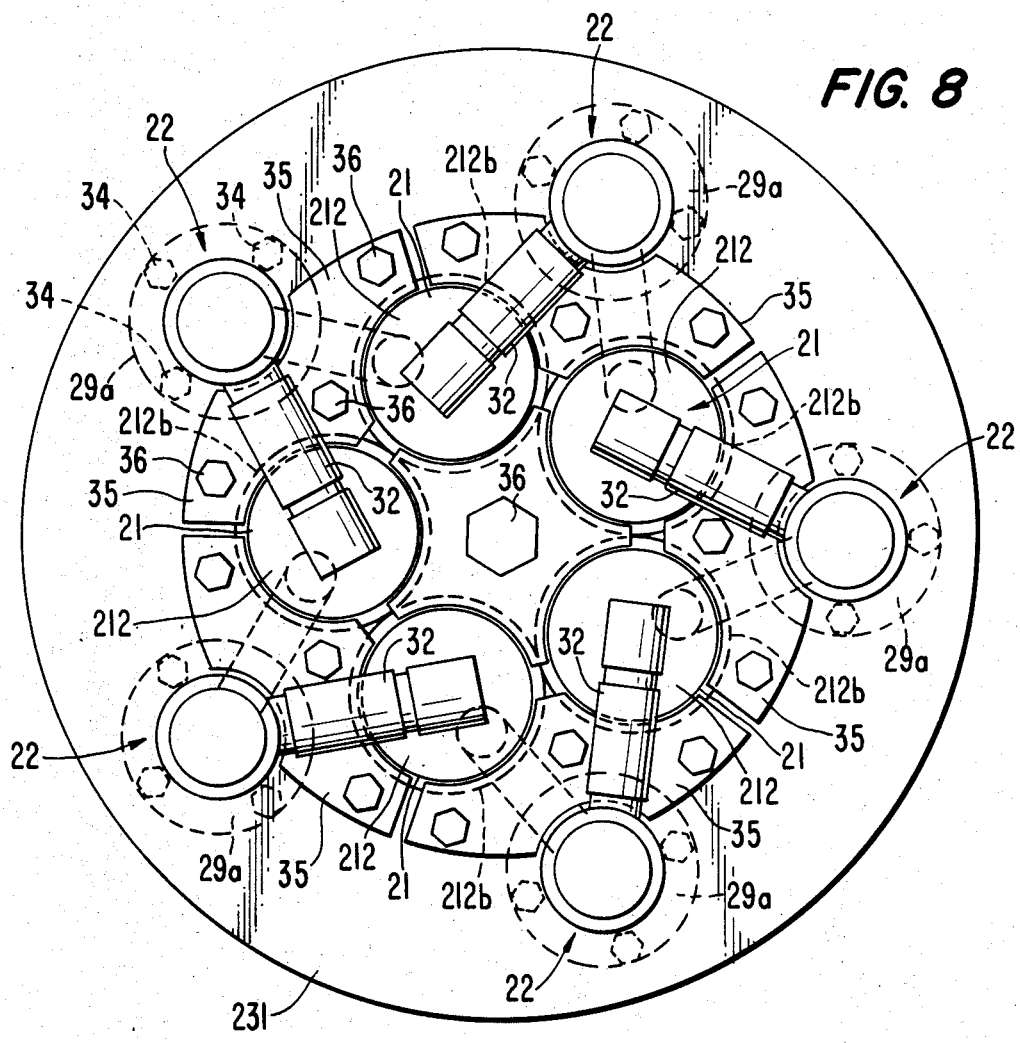
FIG. 8 is a plan view of a modified Stirling cycle type engine according to this invention.
Figure 9:
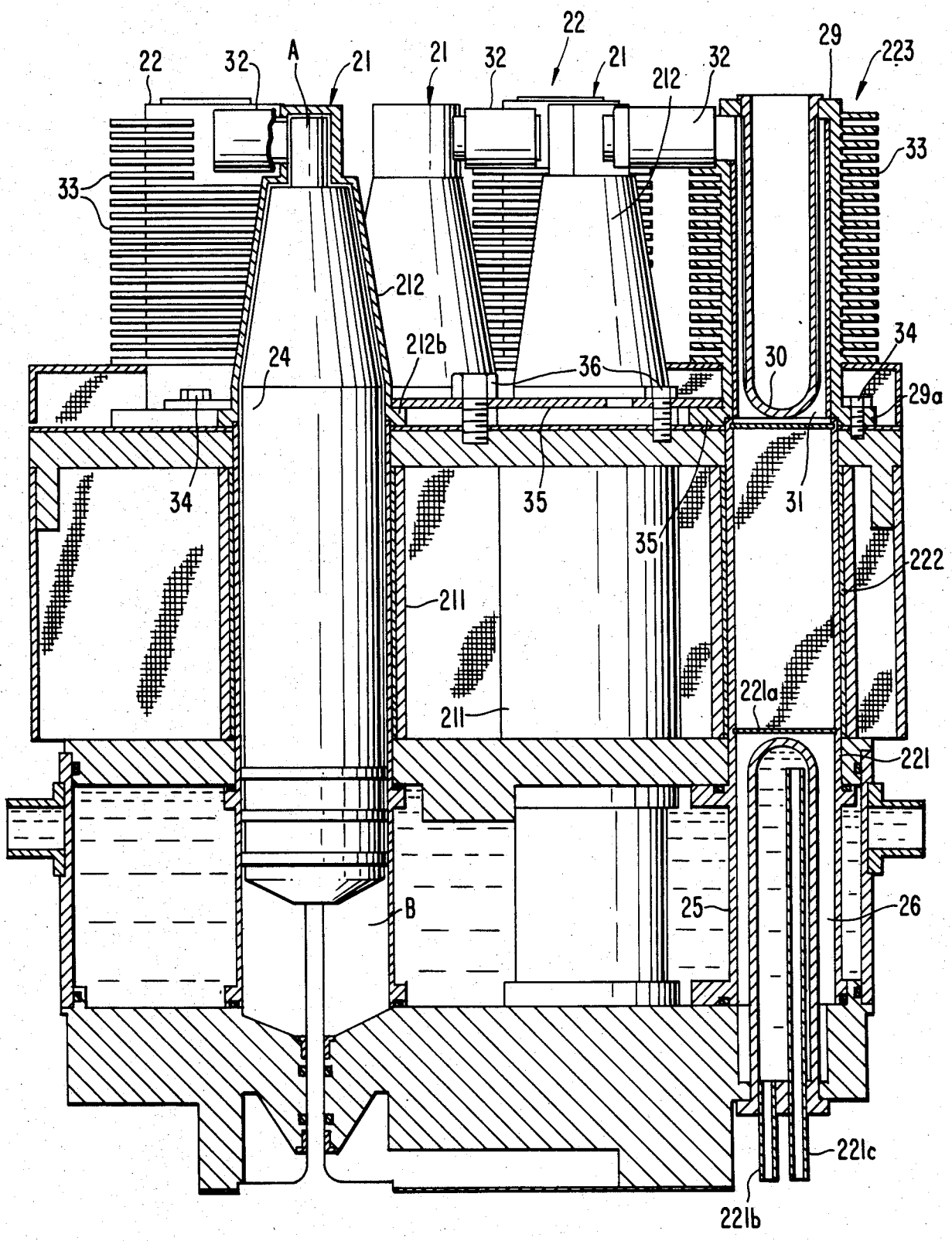
FIG. 9 is a vertical cross-sectional view of the Stirling cycle type engine of FIG. 8.
Figure 10:
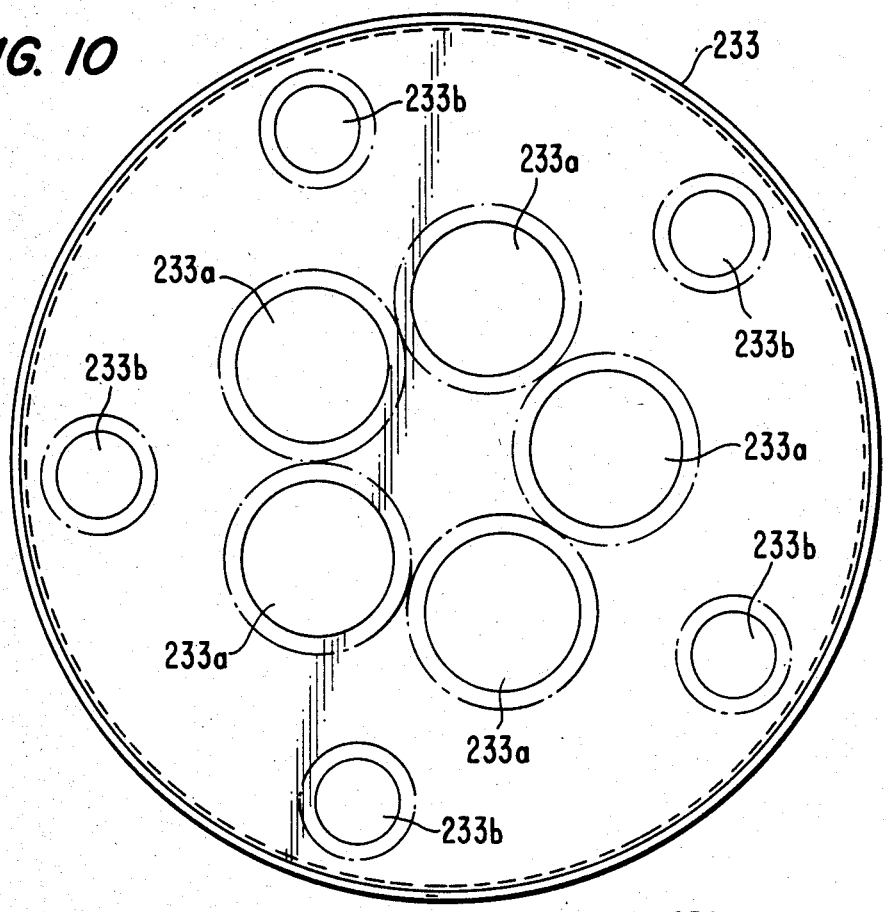
FIG. 10 is a plan view of the third plate element of the supporting frame member used in the Stirling cycle type engine of FIG. 2.

In this structure, cylinder cup 212 and cylindrical member 29 are typically fastened on the outer end surface of second plate element 232 by bolts 34 on radial flange portions 29*a* and 212*b*. Each radial flange 29*a* and 212*b* should be large enough to accomodate bolts 34. An increase in the size of flanges 212*b* increases the diameter of the engine. However, where a smaller diameter engine is desired, radial flange 212*b* of cylinder cup 212 is secured by a plurality of separately affixed plates 35 which are fixed on second plate element 232 by bolts 36 as shown in FIGS. 8 and 9. In such a construction, flange 212*b* can be relatively small. Third plate element 233 is provided with a plurality of holes 233*a* and 233*b* for securing the middle portions of cylinder body 211 and cylindrical member 25, respectively, as shown in FIG. 10. Second insulating member 37 is disposed between second plate element 232 and third plate element 233.

Figure 11:
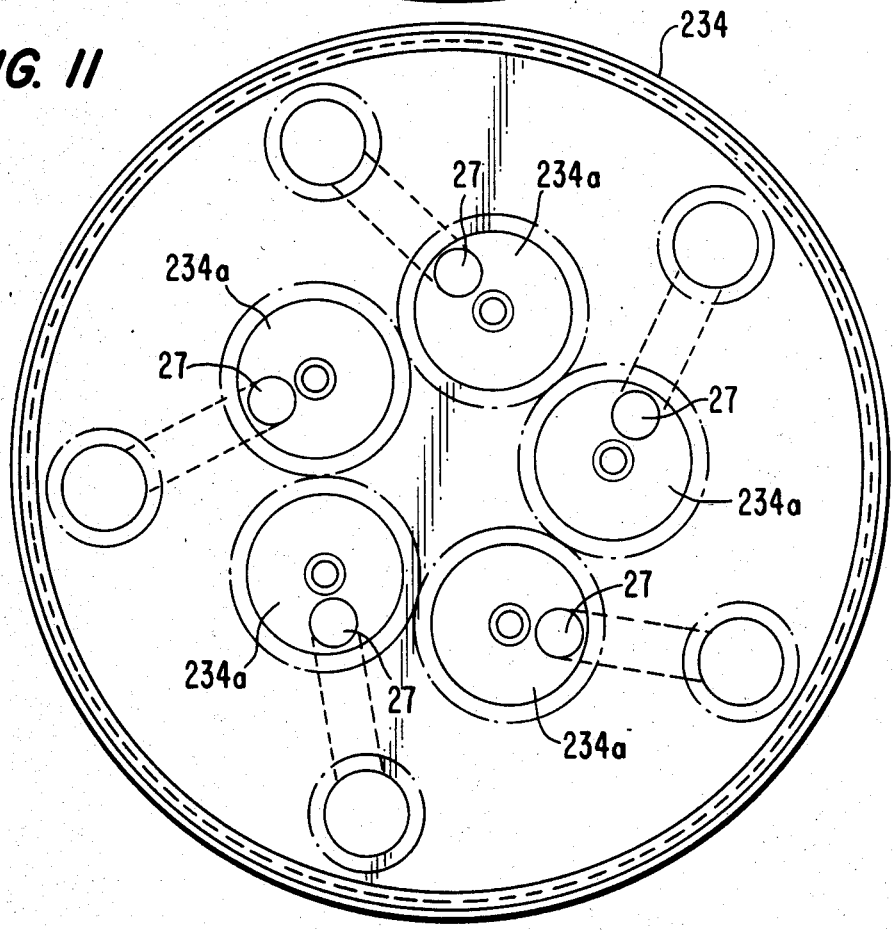
FIG. 11 is a plan view of a bottom plate element of the supporting frame member used in the Stirling cycle type engine of FIG. 2.
Figure 12:
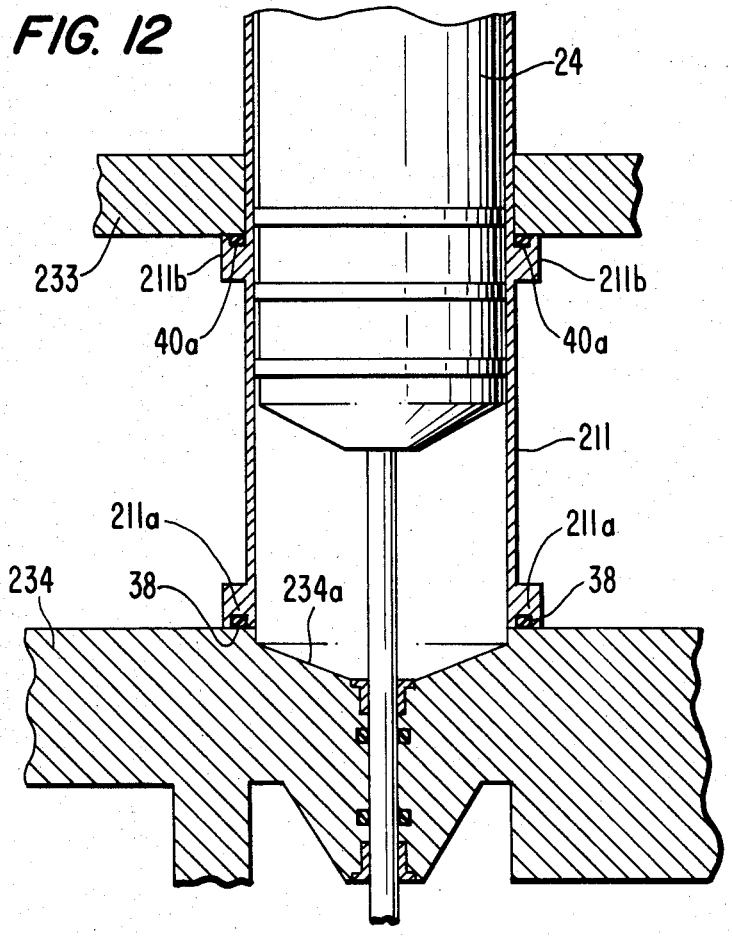
FIG. 12 is an enlarged cross-sectional view of the Stirling cycle type engine of FIG. 2 illustrating the sealing structure of the cylinder.

Bottom plate element 234 of supporting frame member 23 has a plurality of indentations 234*a* which functions as part of cylinders 21, as shown in FIG. 11. Bottom plate element 234 is fastened to the lower end of cylindrical member 25 and cylinder body 211 through radial flange portions 25*a* and 211*a*, respectively. O-rings 38 are disposed between the end surface of bottom plate element 234 and flanges 25*a* and 211*a* to seal therebetween as shown in FIGS. 2 and 12.

Tank 39 is formed between third plate element 233, bottom plate element 234, and annular frame element 391 to hold a cooling liquid, such as water. Cooling water circulates through inlet port 39*a* and outlet port 39*b* fixed on frame element 391. Sealing between frame element 391, and third plate element 233 is accomplished by O-ring 40*a* disposed between the upper inner surface of frame element 391 and the outer peripheral surface of third plate element 233. O-ring 40*b* disposed between the lower inner surface of frame element 391 and axial flange portion 234*b* of bottom plate element 234 provides sealing between frame element 391 and bottom plate element 234. Sealing between third plate element 233, cylindrical member 25 and cylinder body 211 is accomplished by O-rings 40*a* disposed between radial flange portions 25*b* and 211*b* and the bottom surface of third plate element 233. Likewise, O-rings 38 provide sealing between bottom plate member 234, cylindrical member 25, and cylinder body 211. These sealing structures permit the working fluid in each compression chamber B and cooled fluid passageway 26 of cooler 221 to be properly cooled by the cooling water in tank 39 and cooling water container 221*a* of cooler 221.

Crank portion 50 includes a plurality of cylinders 51 which correspond to cylinders 21 of engine body 20, and guide pistons 52 reciprocatingly fitted within cylinders 51. Each guide piston 52 is connected to displacer-piston 24 through first connecting rod 53 extending through bottom plate element 234. Guide piston 52 is also connected to wobble plate 54 through second connecting rod 55. Wobble plate 54 is nutatably supported on supporting shaft 56 through ball 57, but is prevented from rotating by engagement of a pair of bevel gears 58 and the incline surface of edge shaped rotor 59 to which an output shaft is fastened. Therefore, the reciprocating motion of guide piston 52 which is transferred from displacer-piston 24 is converted to the rotating motion of the output shaft through wobble plate 54 and edge shaped rotor 59.

Figure 14:
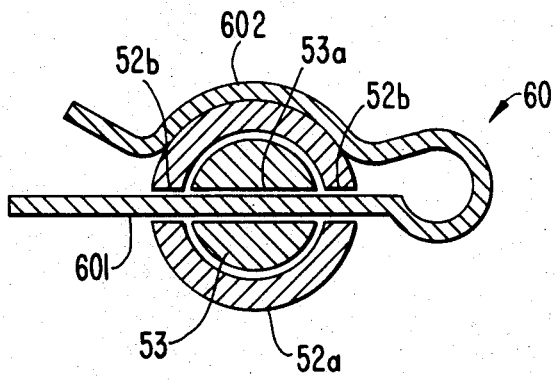
FIG. 14 is a cross-sectional view taken along line X—X in FIG. 13.
Figure 13:
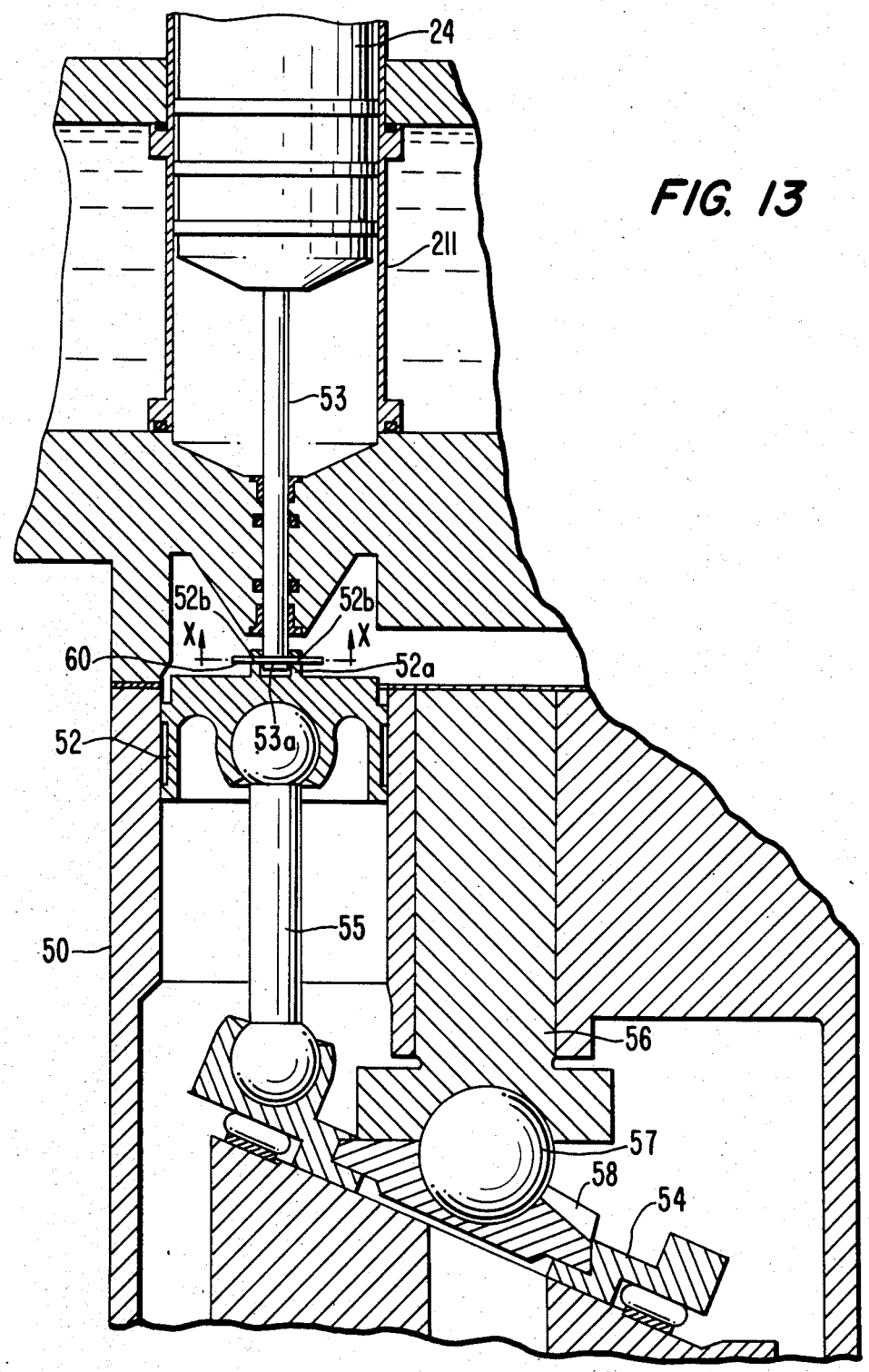
FIG. 13 is a partial cross-sectional view of the crank portion of the Stirling cycle type engine of FIG. 2.

As shown in FIG. 2, first rod 53 is rigidly connected to the upper surface of guide piston 52. However, because the connecting point between wobble plate 54 and second connecting rod 55 follows a curved path due to the nutating movement of wobble plate 54, guide piston 52 is sometimes slanted within cylinder 51 and smooth, reciprocal movement of first rod 53 is hindered. The solution to this problem is shown in FIGS. 13 and 14. One end of first rod 53 and the outer end surface of guide piston 52 are floatingly connected with each other through fastening pin 60 formed of elastic material. Cylindrical projection 52*a* is formed on the outer surface of guide piston 52, and the outer terminal end of first rod 53 is disposed in cylindrical projection 52*a* with a gap. The fastening of first rod 53 and cylindrical projection 52*a* is secured by pin element 601 of pin 60 which penetrates into holes 52*b* and 53*a* formed through cylindrical projection 52*a* and first rod 53, respectively. Pin 60 is held on the outer surface of cylindrical projection 52*a* through supporting element 602. Therefore, first rod 53 can withstand movement within cylindrical projection 52*a*, and reciprocate smoothly.

Figure 15:
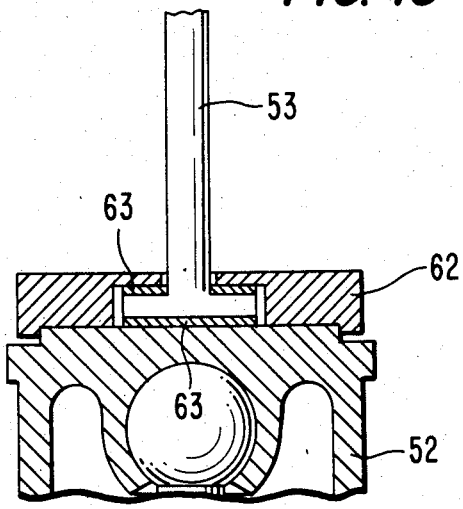
FIG. 15 is a cross-sectional view illustrating a modified connecting structure between the guide piston and connecting rod according to this invention.

An alternate solution, shown in FIG. 15 has first connecting rod 53 slidably connected with guide piston 52. The outer terminal end of first rod 53 is formed with a T-shaped cross-section and is placed between the outer end surface of guide piston 52 and cover plate 62 through sliding plate 63 to permit sliding movement of first rod 53.

Figure 4:
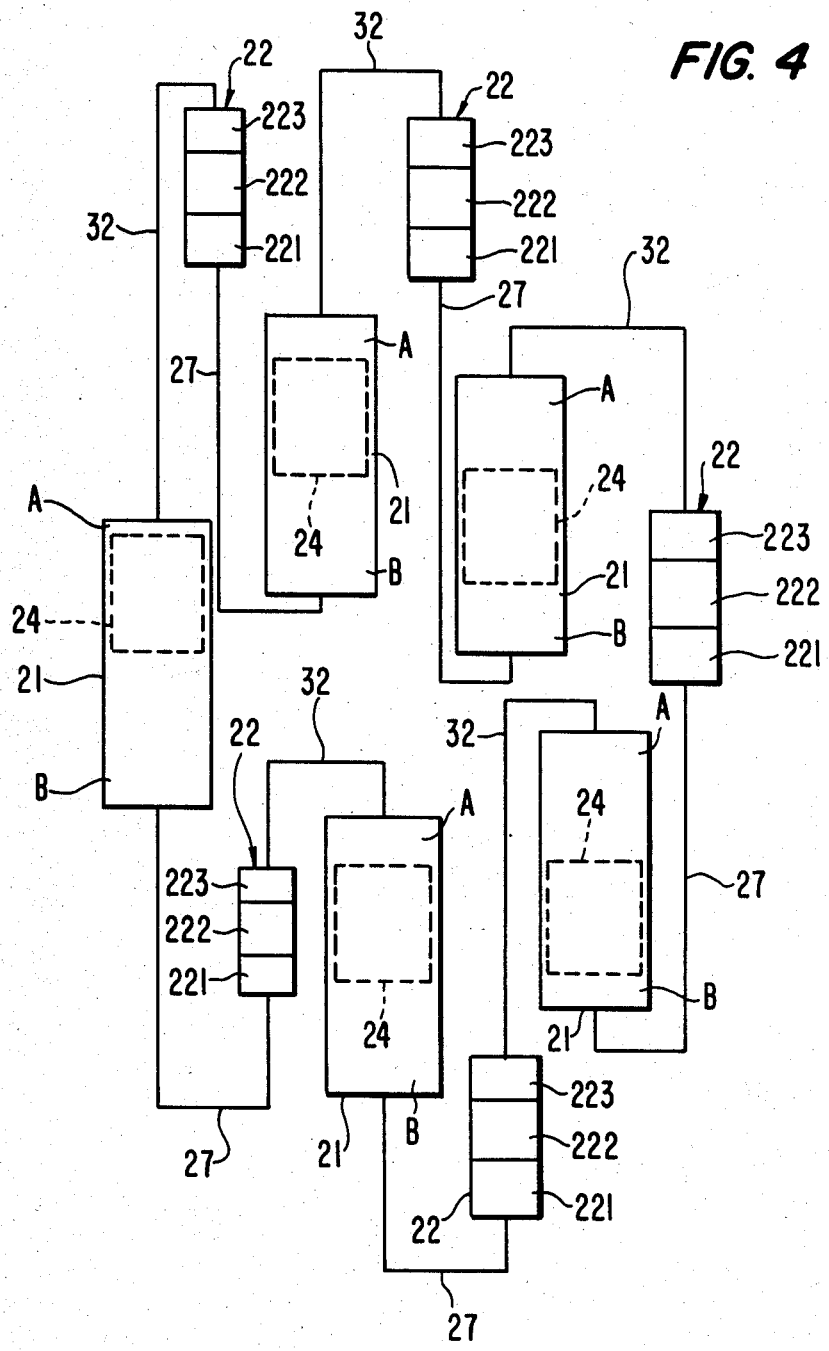
FIG. 4 is a schematic view of a Stirling cycle type engine illustrating its operation.

Referring to FIG. 4, the operation of this engine is as follows. Working fluid in heater 223 is heated by an externally positioned heat source, such as a burner (not shown). The working fluid then expands into expansion chamber A of a first cylinder 21 where it pushes against displacer-piston 24 thereby performing work. Next, the working fluid in expansion chamber A of the first cylinder 21 flows through heated fluid passage pipe 32 to heater 223 and through regenerator 222 where the fluid gives off a high percentage of its head. The remaining heat is removed in cooler 221 where it is absorbed by the cooling water. The outer peripheral surface of cylinder 21 and the interior of cooler 221 are cooled by the circulation of the cooling water in tank 39 and container 221*a* which promotes heat exchange. The working fluid flows into compression chamber B of a second cylinder 21 where it is compressed. Then the working fluid in compression chamber B of the adjacent cylinder 21 flows back through cooler 221, regenerator 222 and heater 223 where it absorbs heat, to expansion chamber A of the first cylinder, where it expands and the process repeats.

Numerous characteristics, advantages and embodiments of the invention have been described in detail in the foregoing description with reference to the accompanying drawings. However, the disclosure is illustrative only and it is to be understood that the invention is not limited to the precise illustrated embodiments. Various changes and modifications may be effected therein by one skilled in the art without departing from the scope or spirit of the invention.

What is claimed:

1. A Stirling cycle type engine comprising:

five cylinders annularly and equiangularly arranged;

a displacer-piston slidably fitted within each said cylinder and dividing an interior space of said cylinder into an expansion chamber for the expansion of a working fluid and a compression chamber for the compression of the working fluid;

heat exchanging elements comprising serially connected cooler means for cooling the working fluid, a regenerator, and heater means for heating the working fluid, said heat exchanging elements being placed equidistantly between said cylinders, each of said heat exchanging elements being in communication with said expansion chamber of one of said cylinders and said compression chamber of an adjacent one of said cylinders;

frame means for supporting said cylinders and said heat exchanging elements, said frame means comprising a plurality of spaced plate elements, said heater means being positioned on one of said plate elements adjacent said expansion chambers of said cylinders; and insulating means disposed in the spaces between said spaced plate elements.

2. The Stirling cycle type engine according to claim 1 wherein each of said cooler means includes a cooled fluid passageway connected to said compression chamber of an adjacent one of said cylinders through a communicating passageway formed in one of said plate elements.

3. The Stirling cycle type engine according to claim 2 wherein each of said heater means includes a heated fluid passageway connected to said expansion chamber of an adjacent one of said cylinders through a pipe element.

4. The Stirling cycle type engine according to claim 1 wherein each of said heat exchanging elements comprises a cylindrical element extended into said frame means and separated into spaces for said cooler means, said regenerator, and said heater means.

5. The Stirling cycle type engine according to claim 4 wherein said heater means comprises an upper portion of said cylindrical element and includes an inner tube extending into an interior space of said cylindrical element with a small gap to define a hot fluid passageway connected to said expansion chamber of an adjacent one of said cylinders.

6. The Stirling cycle type engine according to claim 5 wherein said cylindrical element for said heater means is provided with a plurality of fins and a threaded portion for promoting heat exchange.

7. The Stirling cycle type engine according to claim 6 wherein said fins extend from one surface of said cylindrical element and said threaded portion is formed in an opposite surface of said cylindrical element.

8. The Stirling cycle type engine according to claim 4 wherein said regenerator is placed in a middle portion of said cylindrical element and includes a plurality of wire cloths supported in said middle portion.

9. The Stirling cycle type engine according to claim 4 wherein said cooler means is placed in a lower portion of said cylindrical element and said cooling means extends into an interior of said cylindrical element with a small gap to define a cooled fluid passageway communicating with said compression chamber of an adjacent one of said plate elements.

10. The Stirling cycle type engine according to claim 1, wherein said displacer-piston is connected to a guide piston through a connecting rod and communicates with an output shaft to transfer the movement of said displacer-piston to said output shaft.

11. The Stirling cycle type engine according to claim 10 wherein said connecting rod is floatingly connected to the top surface of said guide piston.

12. The Stirling cycle type engine according to claim 4 whrein said cylindrical elements are located radially outward of said cylinders.

13. The Stirling cycle type engine according to claim 4 wherein said frame means includes a bottom plate element and another plate element spaced vertically above said bottom plate element, and a tank for holding cooling liquid around the lower portion of said cylinders and said cooler means, said tank being defined between said bottom plate element, said another plate element and an annular frame element extending between, and around the perimeter of, said bottom plate element and said another plate element.

* * * * *